US006156709A

United States Patent [19]

Muntz

[11] Patent Number: 6,156,709

[45] **Date of Patent: *Dec. 5, 2000**

[54] LUBRICATING OIL COMPOSITION

[76] Inventor: Pieter Jan Dirk Muntz, 9 Bowman Street, South Perth WA 6151, Australia

[ * ] Notice: This patent issued on a continued prosecution application filed under 37 CFR 1.53(d), and is subject to the twenty year patent term provisions of 35 U.S.C. 154(a)(2).

[21] Appl. No.: 08/833,726

[22] Filed: Apr. 9, 1997

Related U.S. Application Data

[63] Continuation of application No. 08/365,178, Dec. 28, 1994, abandoned, which is a continuation of application No. 08/094,168, Nov. 26, 1993, abandoned.

[30] Foreign Application Priority Data

| | | | |
|---|---|---|---|
| Feb. 4, 1991 | [AU] | Australia | PK4425 |
| Nov. 4, 1991 | [AU] | Australia | PK9259 |
| Dec. 13, 1991 | [AU] | Australia | PK9994 |
| Feb. 4, 1992 | [WO] | WIPO | PCT/AU92/00034 |

[51] Int. Cl.[7] ..... C10M 105/04; C10M 117/00; C10M 127/02

[52] U.S. Cl. ..... 508/539; 208/18; 208/19; 585/1

[58] Field of Search ..... 585/1, 13; 208/18, 208/19; 508/539; C10M 127/02

[56] References Cited

U.S. PATENT DOCUMENTS

| | | | |
|---|---|---|---|
| 1,966,111 | 7/1934 | Becker et al. | 196/151 |
| 3,853,773 | 12/1974 | Martin et al. | 585/2 |
| 4,737,537 | 4/1988 | Schwabe et al. | 524/474 |
| 4,983,313 | 1/1991 | Kaneko et al. | 252/68 |
| 5,362,375 | 11/1994 | Kubo et al. | 208/19 |

FOREIGN PATENT DOCUMENTS

| | | |
|---|---|---|
| 0332433 | 9/1989 | European Pat. Off. . |
| 26 07 614 | 12/1976 | Germany . |
| 209 846 | 5/1984 | Germany . |
| 280 545 | 7/1990 | Germany . |
| 2 224 287 | 5/1990 | United Kingdom . |

*Primary Examiner*—Margaret Medley
*Assistant Examiner*—Cephia D. Toomer
*Attorney, Agent, or Firm*—Jacobson, Price, Holman & Stern, PLLC

[57] ABSTRACT

Lubricating oil compositions containing a medium molecular weight paraffin (MMWP) which is effective in improving the lubricant properties of an engine oil. The medium molecular weight paraffins disclosed include those having from between 10 to 20 carbon atoms. Compositions containing from 0.1% to 2% by volume of the engine oil are disclosed. The MMWP reduces varnishing, sludging, production of chemical byproducts and glazing. It also improves seal life and extends the life of lubricating oil compositions containing it.

32 Claims, No Drawings

LUBRICATING OIL COMPOSITION

This is a continuation of application Ser. No. 08/365,178, filed Dec. 28, 1994 which was abandoned upon the filing thereof; which in turn is a continuation of application Ser. No. 08/094,168, filed Nov. 26, 1993, now abandoned.

The present invention relates to lubricating oil compositions, especially engine oils.

When two metal surfaces move over each other, considerable heat is evolved due to friction. The function of a lubricant is to separate the two rubbing surfaces by a film thereby greatly reducing the coefficient of friction. If this film fails, the frictional heat produced may melt the surfaces causing them to weld together or seize. When conditions are such that a continuous thick (>0.001 in.) film of lubricant separates the solid surfaces at all points, then frictional resistance is controlled by the viscosity of the lubricant. This is referred to as "hydrodynamic lubrication". Under conditions of high speed or high load, thick lubricant films may be absent or incomplete and lubrication of the parts is effected by layers of adsorbed polar molecules. This situation is referred to as "boundary lubrication". Metal surfaces, which are covered by films of metal oxides, are highly polar and hence are not readily "wetted" by non polar hydrocarbon oils. Used alone, hydrocarbon oils are therefore poor lubricants in these circumstances. Lubricants therefore contain additives which either react with metal surfaces or are adsorbed on the surfaces thereby allowing oil to wet the surface or providing boundary lubrication, thus preventing direct metal to metal contact.

Apart from certain speciality products and synthetic oils, the vast bulk of lubricants are based upon hydrocarbons derived from petroleum.

Crude oils contain a number of broad classes of hydrocarbons, the proportions of which vary greatly from oil to oil.

(a) Branched Alkanes

These include iso- and anteiso alkanes, and linear derivatives of isoprene such as phytane and pristane and degradation products from molecules such as carotene. These compounds have low melting points and so confer low pour points on lubricating oils. They are also stable to degradation by heat and oxygen and have high viscosity indexes, so this iso-paraffin group is the preferred feedstock for lube oil manufacture.

(b) n-Alkanes

The paraffins have similar properties to the iso-paraffins, except that, due to their higher melting points, they raise the pour point of a lube oil.

(c) Cycloalkanes

The naphthenics contain five-membered and six-membered rings with alkyl side chains. They lower the pour point of an oil but they have a low viscosity index.

(d) Aromatics

These are derivatives of benzene, naphthalene and other fused ring systems with alkyl side chains. This group has a low viscosity index and poor thermal stability.

(e) Sulphur Compounds

This group forms a substantial proportion of many crudes, especially those from parts of the Middle East. It has similar properties to aromatics, but are usually even less stable.

In order to prepare a suitable lube oil base stock, a manufacturer will select feeds which have appropriate molecular weight ranges and are rich in the desired classes of hydrocarbons (iso-paraffins), and low in aromatics, ONS compounds, and paraffins so that production costs can be kept low. Crudes such as those from Pennyslvania which are ideal for lube oil manufacture are being depleted, so now most manufacturers use a feed stock mix which is carefully selected to meet the product mix required by the market. Some manufacturers upgrade their feedstock by using a severe hydrogenation/hydrogenolysis process called hydrocracking to remove sulphur, aromatics, and to open rings and crack larger molecules.

The residue from the primary distillation of selected crude oils which are rich in iso-paraffins is distilled at reduced pressure (a few mm of Hg) in the presence of steam. Most usually, three fractions are obtained: two distillate cuts and the residue or bottoms. Typical cuts are shown in the table below.

Lubricating Oil Fractions

| Fraction | No. of C atoms | Molecular Weight | Boiling Range ° C. (Plant conditions) |
|---|---|---|---|
| Light (Low viscosity) | 22–36 | 300–500 | 370–500 |
| Medium (medium viscosity) | 29–45 | 400–600 | 450–550 |
| Heavy (high viscosity) | 43 → | 600 → | >500(residue) |

The desired oily alkane material is extracted from the viscous bottoms product from the vacuum tower using liquid propane (high pressure, 65° C.) in a propane de-asphalting plant. The more polar, high molecular weight polycyclic aromatics are less soluble in liquid propane than are the alkane (paraffin) components and are removed as a hard sludge. Evaporation of the propane leaves the heaviest grade of lubricating oil which is usually referred to as "bright stock".

Each of the lube oil fractions is next treated with a solvent system which selectively removes much of the aromatic and O, N, S material. Phenol and more recently furfural have been widely used in elaborate multistage counter current equipment for this purpose. The immiscible, slightly polar solvent selectively extracts the more polar aromatic material from the hydrocarbon mixture.

n-Alkanes (normal paraffins), which have higher melting points than branched alkanes of similar molecular weight, must be removed to decrease the low temperature viscosity of the lubricating oil. This is accomplished by taking the oil up in a suitable solvent such as a methylethylketone-toluene mixture and chilling 5–10° C. below the required pour point. The n-alkanes are precipitated as "slack wax" which is separated by continuous filtration.

The final stage in manufacture of the base stocks is hydrogenation to convert small amounts of dark-coloured unsaturated material into saturated material and to remove sulphur from sulphur compounds present in the oil.

Lubricating oils are finally prepared by blending base stocks to give oil of the desired viscosity range, then introducing many additives to improve the life and performance of the oil.

The chemical composition of lubricating oils derived from crude oil is particularly complex. Normally lubricating oils contain a high proportion of naphthenic or paraffinic compounds. The hydrocarbons comprising a typical lubricating oil may have from 20 to 70 carbon atoms. Usually the hydrocarbons contained in lubricating oil have very few olefinic bonds. However there may be a significant proportion of hydrocarbons exhibiting aromatic unsaturation. A further description of base lubricating oils can be found in an article by D. V. Brock published in "Lubricant Engineering" Volume 43 pages 184–185 March 1987.

Minor improvements in the performance of a lubricating oil can yield significant economic benefits far in excess of the cost of the additive that provides the improved performance. The present invention is based on the discovery that the performance of lubricating oil compositions can be significantly improved by the addition of small amounts of a medium molecular weight paraffin to lubricating oil.

Accordingly the present invention provides an engine oil composition comprising a base lubricating oil and an effective amount of a medium molecular weight paraffin (MMWP). The medium molecular weight paraffin may comprise from 10 to 20 carbon atoms, from 10 to 19 carbon atoms or from 10 to 17 carbon atoms but preferably it comprises from 10 to 15 carbon atoms. The composition may contain as little as 0.1% by volume of MMWP for an improvement in performance to be observed. Preferably however the engine oil composition of the present invention contains from 0.1% to 2.0%, more preferably 0.5% to 1% by volume of a MMWP. Best results have been obtained with about 0.6% by volume MMWP.

MMWP's are normally derived from the processing of crude oils. Normally they are produced during the initial atmospheric distillation of a crude oil and are characterised as hydrocarbons having a boiling point in the range from 150 to 335° C.

The compositions of the present invention may be prepared as compositions ready for use or as concentrates for premixing or mixing in situ e.g. in the sump of an engine. Concentrates may contain as much as 25% of the MMWP. The effective amount of MMWP required depends on the ultimate purpose for its inclusion and may also depend upon the additive selected.

MMWP of particular interest is one known as SHELLSOL T. Shellsol T is characterised as a solvent having the following properties:

| Property | Test Method | Unit | Specification | Typical Value |
|---|---|---|---|---|
| Distillation Ranges, IBP | ASTM D1078 | ° C. | 180 min | 180.2 |
| DP | | | 205 max | 202.5 |
| Flash Point | IP 170 | ° C. | — | 57.5 |
| Aniline Point | ASTM D611 | ° C. | 78–83 | 80 |
| Density @ 15° C. | ASTM D1298 | kg/liter | 0.765–0.775 | 0.769 |
| Composition | | % m | | |
| Paraffins | | | | >99.8 |
| Naphthenes | | | | <0.1 |
| Aromatics | | | | <0.1 |

Other products of particular interest are those from the Shellsol series as well as Shell P874, Shell P878 and Ondina Oil 15. Shell P874 and P878 are technical white oils comprising a mixture of paraffins and naphthenes.

Paraffins of medium molecular weight include dodecane, hexadecane, octadecane and cosane.

The engine oil compositions of the present invention are based on lubricating oil compositions that are normally commercially available. These compositions may include various additives such as dispersants, detergents, oxidation inhibitors, foam inhibitors, pour point depressants and viscosity improvers. A discussion of the function and formulation of lubricating oil compositions can be found in the "Handbook of Lubrication" Theory and Practice of Tribology Volume 1 edited by E. Richard Booser and published by CRC Press in 1983, the contents of which are incorporated herein by reference.

The composition of the present invention may also be incorporated into a grease composition with corresponding improvements in performance. Grease compositions normally comprise a metallic soap and a lubricating oil.

Similarly, the composition of the present invention may be used in other automotive applications.

International Patent Application No. PCT/US89/05467 discloses lubricating oil compositions containing minute quantities of kerosene, the purpose of which is to carry silicone antifoam formulations into solution in a lubricating oil composition. However the quantities of medium molecular weight paraffins contained in the composition would be insufficient to be effective in the performance of the present invention. Normally the MMWP needs to comprise at least 0.1% to 0.5% by volume of the lubricating oil composition to be effective. Furthermore kerosenes frequently contain substantial proportions of aromatics which may negate the effect of the medium molecular weight paraffin.

The engine oils of the present invention provide a number of significant advantages over the existing formulations. These include the following.

1. A noticeable reduction in varnishing;
2. A reduction in sludging;
3. Reduced production of harmful chemical by-products such as acids;
4. Improved seal life particularly seals in gear boxes, differentials and engines;
5. Reduced glazing especially when used in the preferred range;
6. Extended life of the engine oil; and
7. Reduced coefficient of friction of surfaces to which it is applied.

The present invention also includes within its scope methods for any one or more of the following:

a. reducing varnishing in an engine;
b. reducing sludging in an engine;
c. reducing the production of harmful chemical by-products in an engine;
d. improving seal life in an engine; and
e. reducing glazing in an engine by incorporating an effective amount of a medium molecular weight paraffin into lubricating oil used in the engine.

Benefits provided by the present invention are illustrated by the accompanying comparative examples.

EXAMPLE 1

The performance of the compositions of the present invention was compared with the performance of the compositions without the additive of the present invention using a pin on ball testing machine. The pin on ball testing machine comprises an electric motor driving a single shaft through a set of pulleys. A rotatable disc having a diameter of approximately 4 cm is attached to the shaft and is rotated at a speed of 1200–1500 rpm. A separate shaft is pivoted at one end of the apparatus so that a hardened steel bearing element can be applied to the rotating disc. A torque wrench type configuration fitted to the pivoted shaft is used to determine the load applied to the rotating disc by the hardened steel bearing element.

Lubricant under test was applied to the bearing surface by splashing lubricant from a bath held at a base of the rotating disc. At all times during the test a continuous film of lubricant was in contact with the bearing.

A series of seven oil samples was tested with the apparatus both with and without the addition of the additive. Samples including the additive contained additive in the ratio of 1:80 additive to base lubricating oil composition.

The test procedure was as follows. With the disc rotating, a piece of coarse wet and dry energy paper was used to smooth any imperfections and score marks from the rotating disc prior to test. The bearing was moved to ensure a fresh unmarked surface was available for contact with the rotating disc. Prepared samples were poured into an oil bath containing approximately 20 to 40 mls and held in close contact at the base of the rotating disc which picked oil up and carried it across the bearing surface. The bearing fixed to the pivoted shaft was lowered onto the rotating lubricated disc and allowed to settle in. A continuous load was manually applied to the handle of the pivoted shaft. The load was maintained and gradually increased until the bearing surfaces began to squeal. At the point when squealing commenced, the torque applied was measured in ft. lb units. The results are set out in Table 1.

TABLE 1

RESULTS FOR OIL ADDITIVE ASSESSMENT

| Sample | Applied Torque, ft. lb | |
|---|---|---|
| | Without Additive | With Additive |
| 1. SHELL XMO | 80–100 | 150–160 |
| 2. SHELL MARINE OIL | 125 | 160 |
| 3. BP Engine Oil | 80–110 | 140–150 |
| 4. BP Gear Oil | 70 | 140 |
| 5. BP Grease | 130 | 160 |
| 6. Caltex CXT | 50 | 150 |
| 7. Esso Tiger | 80 | 150 |

The additive used in this experiment was "Youngs 303" which is a lubricating oil used in cleaning guns. Gas chromatographic analysis of Youngs 303 revealed that it is a mixture of a lubricating oil and another hydrocarbon fraction of slightly higher boiling point than kerosene. The kerosene like fraction had major components of carbon chain length 11 to 13. The kerosene like fraction comprised approximately 50% of the "Youngs 303".

The results demonstrate that the oil additive provides enhanced performance under the harsh boundary lubrication conditions utilised.

EXAMPLE 2

The performance of the lubricating oil compositions of the present invention were tested against a base lubricating oil composition in a V8 Caterpillar engine (Model 3408) of 450 horsepower. The results of the test are set out in Table 2. The additive used was SHELLSOC T in the ratio of 1:160 by volume.

TABLE 2

V8 CAT Engine

Test Results

| Test I | | | | Test II (with additive) | | | |
|---|---|---|---|---|---|---|---|
| Time -Mins | Burn Rate/ Hr | Horse Power | R.P.M. | Time -Mins | Burn Rate/ Hr | Horse Power | R.P.M. |
| 5 | 61.7 | 221 | 2183 | 5 | 61.3 | 222 | 2184 |
| 10 | 61.7 | 221 | 2183 | 10 | 61.3 | 222 | 2184 |
| 15 | 61.7 | 221 | 2183 | 15 | 61.3 | 222 | 2184 |
| 20 | 61.7 | 221 | 2183 | 20 | 61.3 | 222 | 2184 |

The results of the test demonstrate that the lubricating oil composition of the present invention increases the power output of the motor and increases fuel efficiency.

EXAMPLE 3

A test using a BP lubricating oil as a base was performed on a Holden V8 engine. The additive used was Shellsol T in the ratio 1:160. The results are illustrated in Table 3.

TABLE 3

Holden 253 V8 using B.P. Oil.

| | WITHOUT ADDITIVE | WITH ADDITIVE | |
|---|---|---|---|
| L/IDLE | 650 | 775 | 775 |
| H/IDLE | — | — | — |
| H/P | — | — | — |
| TORQUE | 110 | 110 | — |
| W/TEMP | 85 | 95 | 85 |
| OIL/TEMP | — | — | — |
| OIL/PRESS | 120 | 100 | — |
| E/VACUUM | — | — | — |

The dynamometer consistently indicated that the lubricating oil compositions of the present invention resulted in an idle speed that was consistently 125 rpm greater than that for the base lubricating oil.

EXAMPLE 4

The lubricating oil composition of the present invention was compared with a base lubricating oil over a range of engine speeds. The additive used was SHELLSOL T in the ratio 1:160. The engine used was a Caterpillar (Model 3406) six cylinder 400 horsepower engine. The results of the test are shown in Tables 4 and 5. Table 4 illustrates the performance of the engine using the base lubricating oil composition and Table 5 illustrates the performance of the same engine using a lubricating oil composition of the present invention.

TABLE 4

| | Specifications | Test Figures Without Additive |
|---|---|---|
| Low Idle R.P.M. | 750 | 758 |
| High Idle R.P.M. | 2280 | 2307 |
| Full Load R.P.M. | 2100 | 2100 |

TABLE 4-continued

| | |
|---|---|
| Rack Setting | 1.15 |
| Boost Pressure | 33" |
| B.S.F.C. | .357 |
| H.P. Setting | 347 |
| Lube Oil Pressure at High Idle | |
| Lube Oil Pressure at Low Idle | |

| RPM | H.P. | GPH FUEL RATIO | BOOST | EXHAUST TEMP. | FUEL PRESS | WATER TEMP. | OIL TEMP. | OIL PRES |
|---|---|---|---|---|---|---|---|---|
| 2300 | 9 | | 8 | 333 | 230 | 89.3 | 100.9 | 445 |
| 2200 | 223 | | 26 | 365 | 220 | 88.9 | 100.9 | 420 |
| *2100 | 315 | | 45 | 401 | 220 | 89.7 | 100.3 | 415 |
| 2000 | 326 | | 44 | 381 | 220 | 90.2 | 100.1 | 410 |
| 1900 | 322 | | 43 | 377 | 220 | 90.1 | 100.1 | 405 |
| 1800 | 320 | | 43 | 377 | 220 | 89.4 | 99.6 | 400 |
| 1700 | 315 | | 41 | 385 | 220 | 89.6 | 98.6 | 400 |
| 1600 | 309 | | 30 | 401 | 220 | 90.6 | 98.7 | 400 |
| 1500 | 297 | | 27 | 423 | 220 | 90.6 | 99.2 | 400 |
| 1400 | 287 | | 25 | 456 | 220 | 89.7 | 98.5 | 395 |

TABLE 5

| | Specifications | Test Figures With Additive |
|---|---|---|
| Low Idle R.P.M. | 750 | 772 |
| High Idle R.P.M. | 2280 | 2304 |
| Full Load R.P.M. | 2100 | 2100 |
| Rack Setting | | |
| Boost Pressure | | |
| B.S.F.C. | | |
| H.P. Setting | | |
| Lube Oil Pressure at High Idle | | |
| Lube Oil Pressure at Low Idle | | |

| RPM | H.P. | GPH FUEL RATIO | BOOST | EXHAUST TEMP. | FUEL PRESS | WATER TEMP. | OIL TEMP. | OIL PRES |
|---|---|---|---|---|---|---|---|---|
| *2309 | 38 | | 6 | 292 | 230 | 88.0 | 94.9 | 450 |
| *2200 | 231 | | 24 | 334 | 220 | 89.5 | 96.9 | 440 |
| *2100 | 317 | | 45 | 404 | 220 | 90.6 | 100.3 | 420 |
| 2000 | 326 | | 44 | 398 | 220 | 90.0 | 99.5 | 410 |
| 1900 | 322 | | 43 | 390 | 220 | 89.4 | 99.7 | 400 |
| 1800 | 320 | | 41 | 386 | 220 | 89.9 | 99.8 | 400 |
| *1700 | 318 | | 40 | 394 | 220 | 88.9 | 98.7 | 400 |
| *1600 | 310 | | 30 | 410 | 220 | 89.5 | 98.9 | 400 |
| *1500 | 299 | | 26 | 440 | 220 | 88.7 | 98.2 | 400 |
| 1400 | 284 | | 25 | 467 | 220 | 88.9 | 97.2 | 390 |

The results illustrate that the lubricating oil composition of the present invention produces an increase in power output of 2 to 3 horsepower at low revs and at full load.

EXAMPLE 5

Engine Test illustrating anti-varnish benefits:

When added to a 4 liter 6 cylinder engine, which had done over 130,000 kms, and which was beginning to "breathe" noticeably—due to "varnishing", and after approximately 4,000 kms running with an oil change after 2,000 kms with additive, all "breathing" ceased, as observed with the naked eye. The additive used was SHELL SOL T in the ratio of 1:160. Combustion was noticeably steadier and more even.

The same experiment was performed with another engine of similar age, and the same results were achieved.

Oil leaks from each of the motors were also reduced and in particular around the crankshaft protrusions.

With the additive included in further oil changes—the result of "no breathing" was continued indefinitely, with the benefit of cleaner oil, next to no oil burning and better running.

Of course along with this other benefits were observed such as improved fuel efficiency, increased engine performance and reduced engine wear.

What is claimed is:

1. An engine oil composition comprising a base lubricating oil and between 0.1% to 2% by volume of an additive which comprises paraffinic and naphthenic carbon percentages of 58% and 42%, respectively, has a flash point of 106° C., an aniline point of 82° C., and density of 0.807 kgm/liter.

2. An engine oil composition comprising a base lubricating oil and between 0.1% to 2% by volume of an additive which comprises paraffinic and naphthenic carbon percentages of 79% and 21%, respectively, has a flash point of 146° C., an aniline point of 97° C., and a density of 0.799 kgm/liter.

3. A method of reducing varnishing in an internal combustion engine which method comprises the step of lubricating the engine with an engine oil composition comprising a base lubricating oil and at least 0.1% by volume of a medium molecular weight paraffin, wherein lubricant properties of the engine oil composition are substantially improved, the medium molecular weight paraffin comprising between 10 to 20 carbon atoms.

4. A method for improving lubricant properties of an internal combustion engine oil composition comprising the step of adding, in an amount between 0.1 to 2% by volume of the engine oil, a medium molecular weight paraffin comprising between 10 to 20 carbon atoms, to an engine oil composition.

5. The method of claim 4 further comprising the step of adding the paraffin in an amount of between 0.5 to 1% by volume of the engine oil.

6. A lubricating oil composition comprising (a) a base lubricating oil of high molecular weight having between 20 and 70 carbon atoms and (b) between 0.1% and 2% by volume of an additive which comprises paraffins of medium molecular weight having between 10 and 19 carbon atoms, so as to be effective in removing varnish from engines and reducing the coefficient of friction between surfaces, wherein the additive comprises a paraffin carbon percentage of greater than 99.8%, a naphthene carbon percentage of less than 0.1% and an aromatic carbon percentage of less than 0.1%, has a flash point of 57.5° C., an aniline point of 80° C., and a density of 0.765–0.775 kg/liter.

7. The oil composition as claimed in claim 6, wherein the paraffins have between 10 and 17 carbon atoms.

8. The oil composition as claimed in claim 6, wherein the paraffins have between 10 and 15 carbon atoms.

9. A lubricating oil composition comprising (a) a base lubricating oil of high molecular weight having between 20 and 70 carbon atoms and (b) between 0.1% and 2% by volume of an additive which comprises paraffins of medium molecular weight having between 10 and 19 carbon atoms, so as to be effective in removing varnish from engines and reducing the coefficient of friction between surfaces, wherein the additive further comprises naphthenes, and the paraffins and the naphthenes have carbon percentages of 58% and 42%, respectively.

10. A lubricating oil composition comprising (a) a base lubricating oil of high molecular weight having between 20 and 70 carbon atoms and (b) between 0.1% and 2% by volume of an additive which comprises paraffins of medium molecular weight having between 10 and 19 carbon atoms, so as to be effective in removing varnish from engines and reducing the coefficient of friction between surfaces, wherein the additive further comprises naphthenes, and the paraffins and the naphthenes have carbon percentages of 79% and 21%, respectively.

11. The oil composition as claimed in claim 6, wherein the additive is present in an amount of 0.5% to 1.25% by volume.

12. The oil composition as claimed in claim 6, wherein the additive is present in an amount of 0.5% to 1% by volume.

13. The oil composition as claimed in claim 6, wherein the additive is present in an amount of 0.6% by volume.

14. A lubricating oil composition comprising (a) a base lubricating oil of high molecular weight having between 20 and 70 carbon atoms and (b) between 0.1% and 2% by volume of an additive which comprises paraffins of medium molecular weight having between 10 and 19 carbon atoms, so as to be effective in removing varnish from engines and reducing the coefficient of friction between surfaces, wherein the additive further comprises naphthenes and the paraffins and the naphthenes have a carbon percentage of 58% and 42%, respectively, wherein the additive is present in an amount of 0.5% to 1.25% by volume.

15. A lubricating oil composition comprising (a) a base lubricating oil of high molecular weight having between 20 and 70 carbon atoms and (b) between 0.1% and 2% by volume of an additive which comprises paraffins of medium molecular weight having between 10 and 19 carbon atoms, so as to be effective in removing varnish from engines and reducing the coefficient of friction between surfaces, wherein the additive further comprises naphthenes and the paraffins and the naphthenes have a carbon percentage of 58% and 42%, respectively, wherein the additive is present in an amount of 0.5% to 1% by volume.

16. A lubricating oil composition comprising (a) a base lubricating oil of high molecular weight having between 20 and 70 carbon atoms and (b) between 0.1% and 2% by volume of an additive which comprises paraffins of medium molecular weight having between 10 and 19 carbon atoms, so as to be effective in removing varnish from engines and reducing the coefficient of friction between surfaces, wherein the additive further comprises naphthenes and the paraffins and the naphthenes have a carbon percentage of 79% and 21%, respectively, wherein the additive is present in an amount of 0.5% to 1.25% by volume.

17. A lubricating oil composition comprising (a) a base lubricating oil of high molecular weight having between 20 and 70 carbon atoms and (b) between 0.1% and 2% by volume of an additive which comprises paraffins of medium molecular weight having between 10 and 19 carbon atoms, so as to be effective in removing varnish from engines and reducing the coefficient of friction between surfaces, wherein the additive further comprises naphthenes and the paraffins and the naphthenes have a carbon percentage of 79% and 21%, respectively, wherein the additive is present in an amount of 0.5% to 1% by volume.

18. A method for reducing varnishing and improving lubrication in mechanical systems of internal combustion engines, which method comprises the step of lubricating the engine, with a lubricating oil composition comprising (a) a bases lubricating oil of high molecular weight having between 20 and 70 carbon atoms and (b) from 0.1% to 2% by volume of an additive comprising paraffins of medium molecular weight having between 10 and 19 carbon atoms.

19. The method of claim 18, wherein the lubricating oil composition comprises 0.1% to 1.25% by volume of said additive.

20. A grease composition comprising a thickener and a lubricating oil composition having between 0.1% and 2% by volume of an additive which comprises paraffins of medium molecular weight having between 10 and 19 carbon atoms, so as to be effective in reducing the coefficient of friction between surfaces.

21. The grease composition according to claim 20, wherein the additive further comprises naphthenes.

22. The grease composition according to claim 20, wherein the additive further comprises naphthenes, and the paraffins have between 10 and 17 carbon atoms.

23. The grease composition according to claim 20, wherein the additive further comprises naphthenes, and the paraffins have between 10 and 15 carbon atoms.

24. The grease composition according to claim 20, wherein the additive further comprises naphthenes, and the paraffins and naphthenes have carbon percentages of 58% and 42%, respectively.

25. The grease composition according to claim 20, wherein the additive further comprises naphthenes, and the paraffins and naphthenes have carbon percentages of 79% and 21%, respectively.

26. The grease composition according to claim 20, wherein the additive comprises a paraffinic carbon percentage of greater than 99.8%, a naphthenic carbon percentage of less than 0.1% and an aromatic carbon percentage of less than 0.1%, has a flash point of 57.5° C., an aniline point of 80° C., and a density of 0.765–0.775 kg/liter.

27. The method of claim 18, wherein the additive further comprises naphthenes.

28. The grease composition of claim 20, wherein the additive further comprises naphthenes.

29. The grease composition of claim 20, wherein the thickener is a metallic soap.

30. A method for improving lubrication in mechanical systems selected from the group consisting of internal combustion engines, gear boxes and differentials which method comprises the step of lubricating the engine, with a lubricating oil composition comprising (a) a base lubricating oil of high molecular weight having between 20 and 70 carbon atoms and (b) 0.1% to 2% by volume of an additive comprising paraffins of medium molecular weight having between 10 and 19 carbon atoms.

31. The method of claim 30, wherein the lubricating oil composition comprises 0.1% to 1.25% by volume of said additive.

32. The method of claim 30, wherein the additive further comprises naphthenes.

* * * * *